US006244996B1

(12) United States Patent
Sencil

(10) Patent No.: US 6,244,996 B1
(45) Date of Patent: Jun. 12, 2001

(54) LEG EXTENSION MACHINE

(75) Inventor: Philip Sencil, Ocala, FL (US)

(73) Assignee: MedX 96, Inc., Ocala, FL (US)

( * ) Notice: Subject to any disclaimer, the term of this patent is extended or adjusted under 35 U.S.C. 154(b) by 0 days.

(21) Appl. No.: 09/365,709

(22) Filed: Aug. 3, 1999

(51) Int. Cl.[7] ..... A67B 21/06
(52) U.S. Cl. ..... 482/97; 482/137; 482/139
(58) Field of Search ..... 482/97, 100, 137–139, 482/145; 601/34, 75

(56) References Cited

U.S. PATENT DOCUMENTS 4,822,038 * 4/1989 Maac ..... 482/97
4,838,548 * 6/1989 Marc ..... 482/97
5,263,914 * 11/1993 Simonson et al. ..... 482/100
5,338,274 * 8/1994 Jones ..... 482/100
5,462,507 * 10/1995 Nichols et al. ..... 482/104
5,669,865 * 9/1997 Gordon ..... 482/145
6,074,328 * 6/2000 Johnson ..... 482/97

* cited by examiner

*Primary Examiner*—John Mulcahy
(74) *Attorney, Agent, or Firm*—William E. Mouzavires

(57) ABSTRACT

A leg extension exercise machine having a movement arm engaged by the legs for moving the movement arm between a retracted position and an extended position. The movement arm has a vertically adjustable foot bar for holding the feet and preventing downward movement of the feet during the exercise. Resistance to the exercise is provided by a weight arm having one or more weight plates mounted thereon and pivotally connected to the movement arm. The prop is pivotally mounted to the fixed frame of the machine for movement between an extended position holding the weight arm in a raised position to facilitate entry to and exit from the machine by the exerciser. The prop arm is moveable by the exerciser into a retracted position for storage by means of a handle.

12 Claims, 5 Drawing Sheets

LEG EXTENSION MACHINE

FIELD AND OBJECTS OF THE PRESENT INVENTION

The present invention relates to leg extension exercise machines wherein the exerciser is typically seated and moves the legs between a retracted position adjacent the seat of the machine and an extended position displaced over 90° (degrees) from the retracted position.

A primary object of the present invention is to provide a novel and improved leg extension exercise machine of the type described.

A further object of the present invention is to provide a novel and improved leg extension machine employing free weights in providing a resistance to extension of the legs during the exercise.

Another object of the present invention is to provide a novel and improved leg extension exercise machine which prevents plantar flexion of the feet during the exercise thereby lending itself for use in rehabilitating the knee after surgery.

A further object of the present invention is to provide a novel and improved leg extension exercise machine which facilitates handling of resistance weight plates between storage and use position on the machine.

SUMMARY OF PREFERRED EMBODIMENT OF THE PRESENT INVENTION

In summary a preferred embodiment of the present invention includes a frame including a seat and back rest assembly for supporting the exerciser while allowing the exerciser to extend the legs from a retracted position adjacent to the seat to an extended position displaced from the seat at least 90° (degrees) and preferably 135° (degrees). Pivotally mounted to the frame is a movement arm including two leg pads engagable by the shins to move the movement arm between retracted and extended positions. In the preferred embodiment the leg pads have an elongated concave recess for accommodating the shins of the exerciser. In addition an adjustable foot bar is provided below the pads for receiving the feet of the exerciser to prevent downward movement or plantar flexion of the feet during the exercise. A resistance weight arm is pivotally mounted to the frame and connected to the movement arm by a linkage for providing resistance to movement of the movement arm to the extended position. One or more weight plates are mounted on the weight arm from a storage area including a rack fixed to the frame with the heaviest weight plates located at the waist-chest area of the exerciser to facilitate handling of the weights. In order to facilitate entry to or exit from the machine, a prop arm is mounted to the frame for movement between a use position where it engages and holds the weight arm in raised position and a storage position spaced from the weight arm.

DRAWINGS

Other objects and advantages of the present invention will become more apparent from the following more detailed description taken in conjunction with the attached drawings in which.

DETAILED DESCRIPTION

Figure 1:
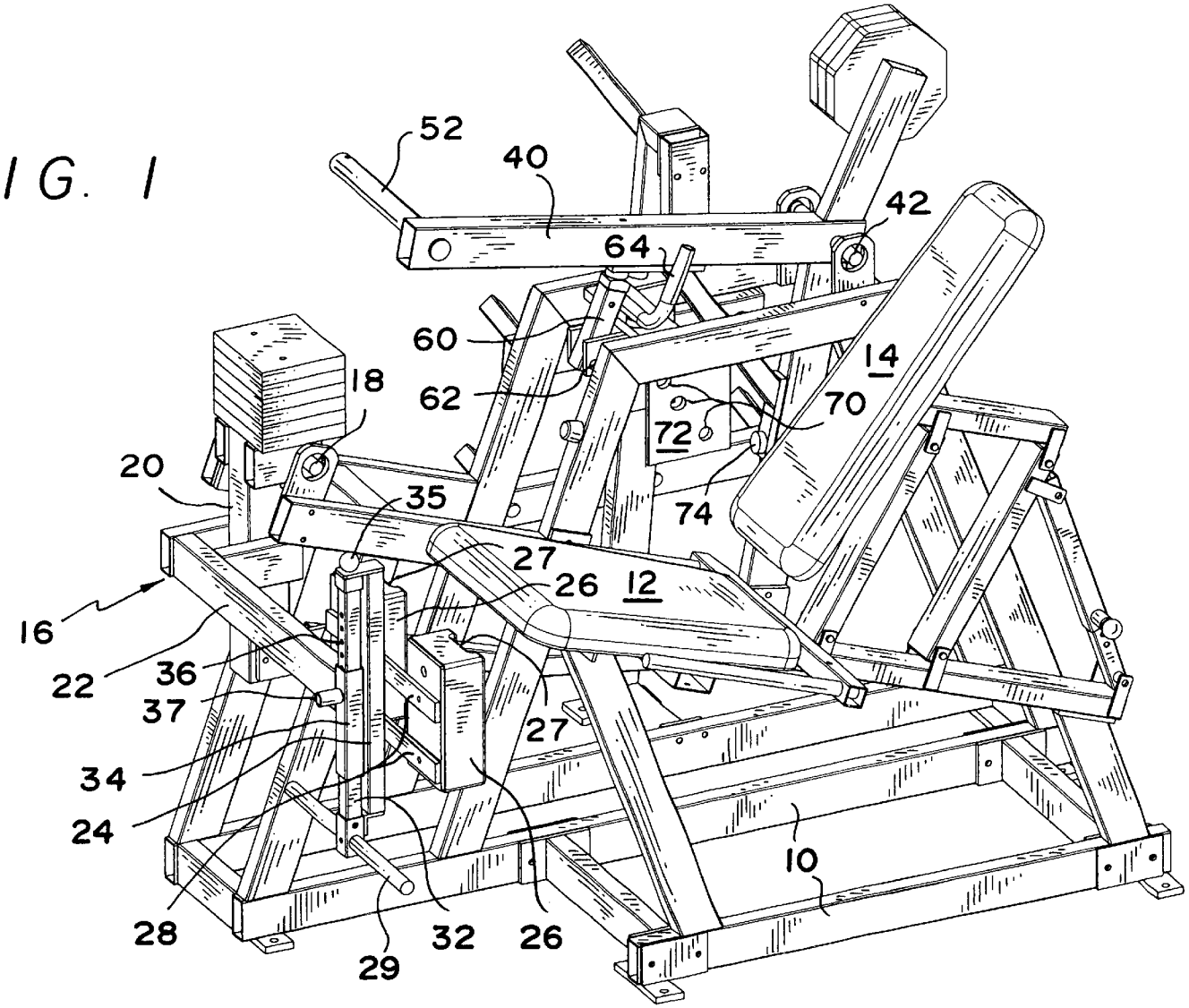
FIG. 1 is a perspective view of a preferred embodiment of a leg extension exercise machine in accordance with the present invention.
Figure 3:
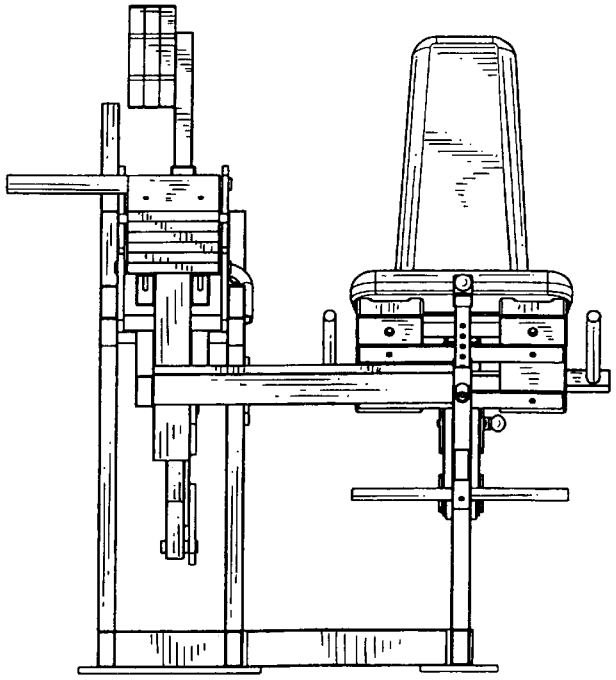
FIG. 3 is a front elevational view of the machine shown at the start of an exercise.

Referring now to the drawings in detail, there is shown in FIG. 1 a leg extension exercise machine constituting a preferred embodiment of the present invention and including a stationary support frame 10, of any suitable construction such as tubular steel or alloy members. Supported on the frame are a seat 12 and backrest 14 for holding an exerciser during extension of a movement arm generally designated 16 by the legs, between a retracted position shown in FIG. 2 and an extended position shown in FIG. 7. Movement arm 16, is pivoted at pivot 18, to the frame for movement between the aforementioned retracted and extended positions. Movement arm 16, includes a vertical mounting member 20 pivotally mounted to the frame, and a cross-member 22 fixed to the mounting member 20 and extending therefrom to a vertical leg member generally designated 24. In the preferred embodiment the latter includes a pair of leg pads 26, fixed by brackets 28 to the leg member 24. Leg pads have elongated concave surfaces 27 for receiving and accommodating the shins of the exerciser which engage the leg pads for moving movement arm 16 between the retracted and extended positions.

In accordance with one of the features of the present invention, an adjustable foot support generally designated 29 is mounted for vertical movement along with leg bar 24, for receiving the feet of the exerciser to prevent downward movement of the feet during the exercise. This prevents plantar flexion. Foot support 29 is fixed to a foot bar slide 32 received in a receptacle tube 34 fixed to the cross-member 22. Handle bar 35 is provided on the top of the slide and leg bar assembly for moving it vertically into the adjusted position. A plurality of holes 36 are spaced along the slide 32 for receiving a locking pin 37. By adjusting the slide 32, the position of the leg pads 26 and foot bar 29 may be obtained for a particular exerciser.

Figure 2:
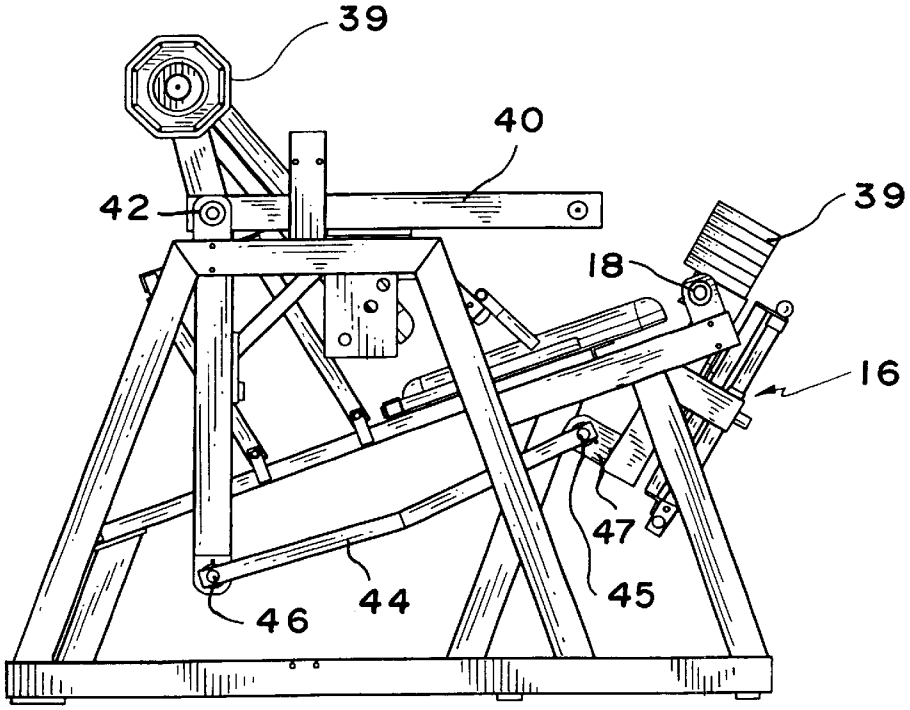
FIG. 2 is a right-hand side elevational view of the machine shown in a start position at the start of an exercise.
Figure 5:
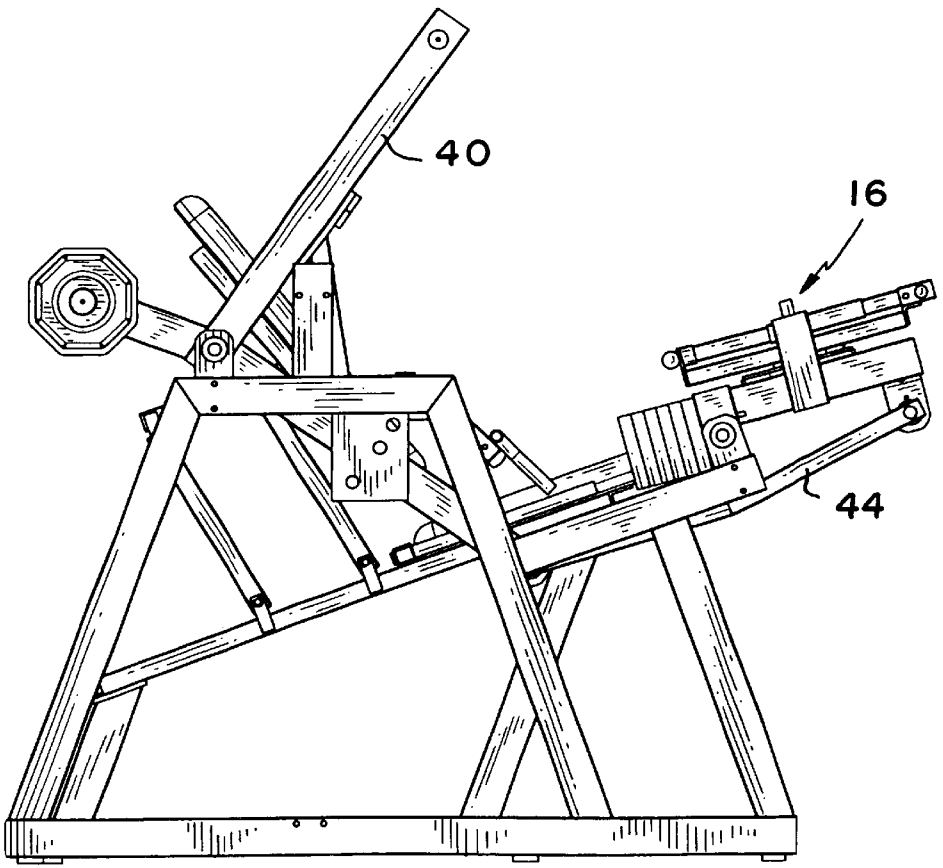
FIGS. 5, 6 and 7 are similar to FIGS. 2, 3 and 4 but with the exception that the machine is shown at the finish of an exercise.
Figure 4:
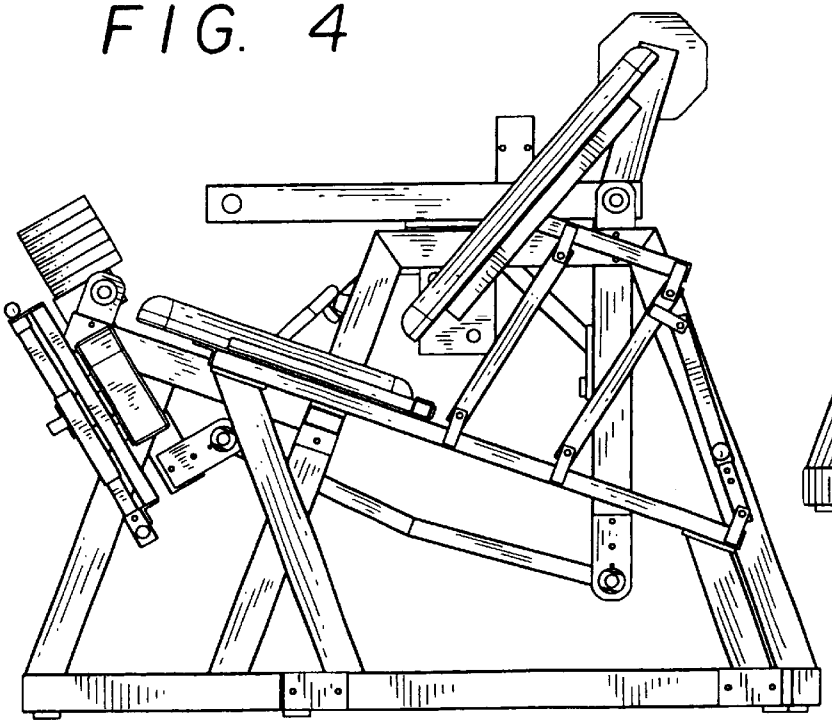
FIG. 4 is a left-hand side elevational view of the machine shown at the start of an exercise.
Figure 7:
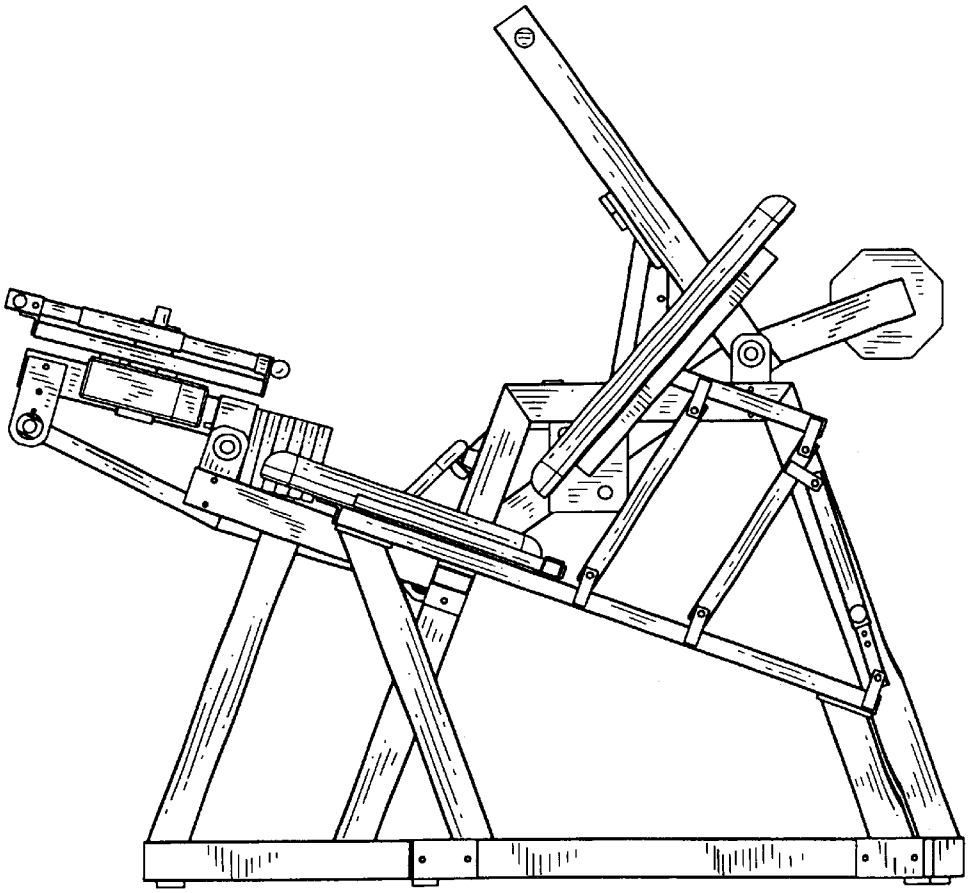
Figure 6:
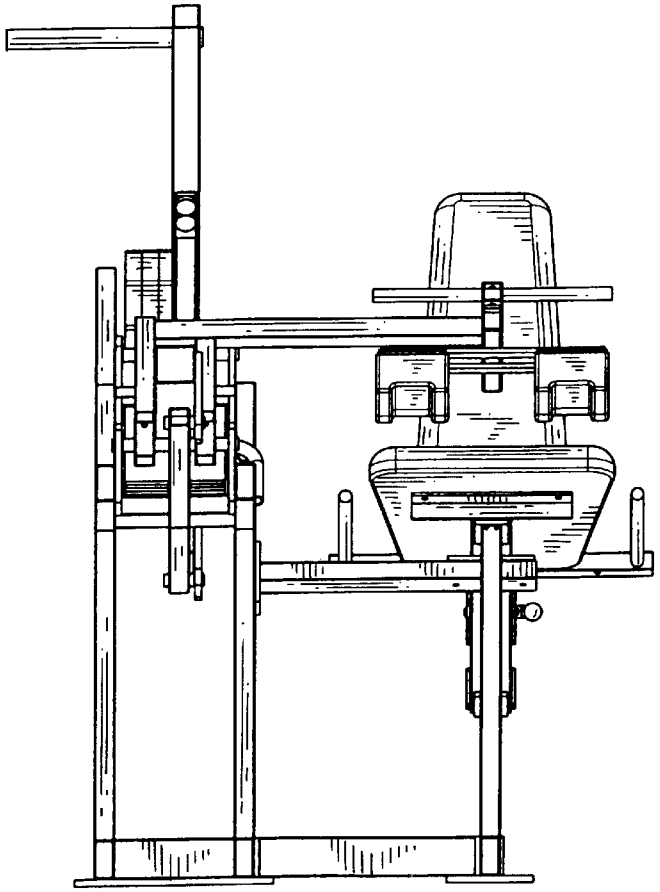
Figure 8:
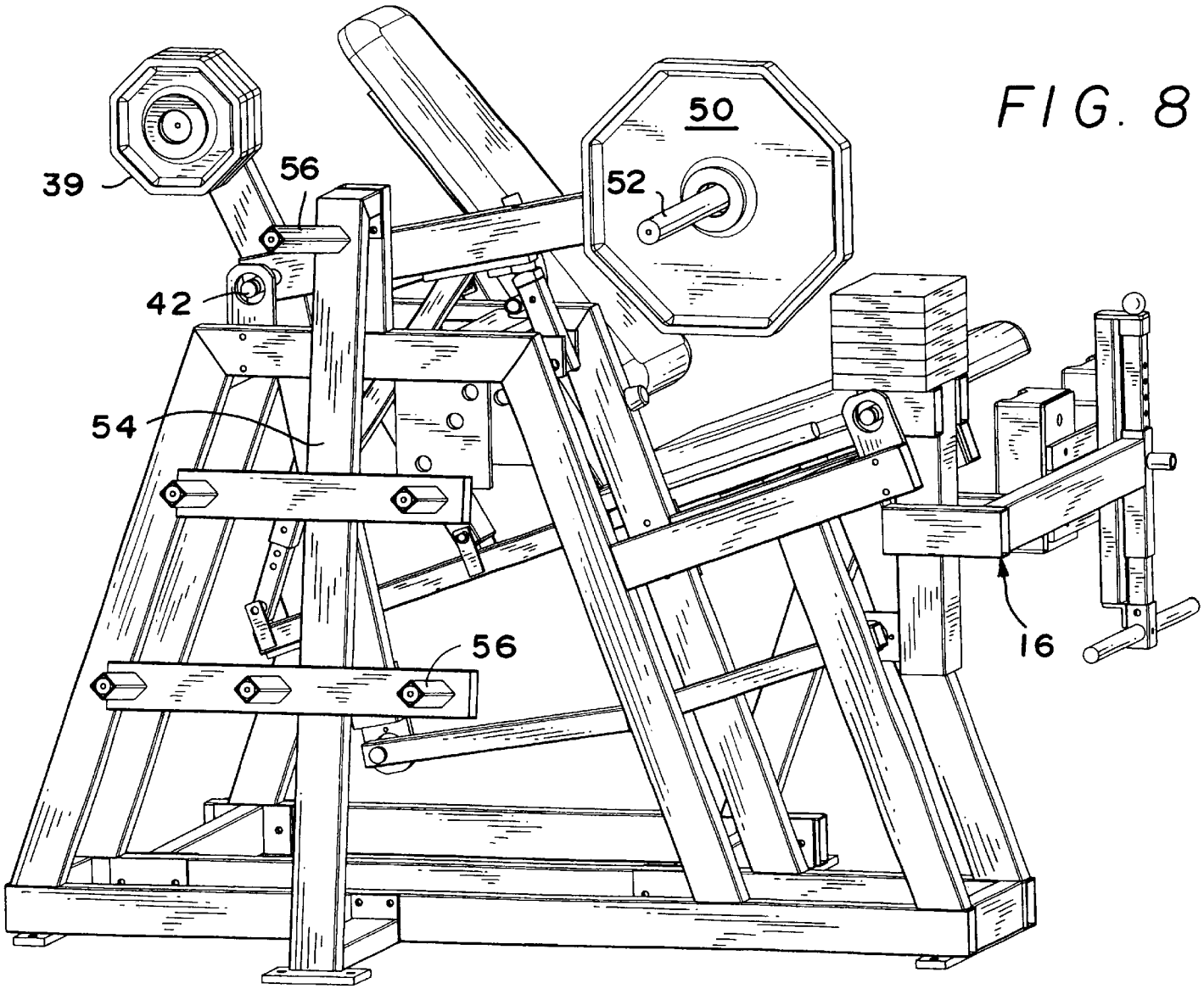
FIG. 8 is a perspective view generally similar to FIG. 1 but taken from the opposite side of the machine.

Resistance to the exercise described above is provided through means of a weight arm generally designated 40, pivotally mounted by pivot 42 to the frame for movement between a start position shown in FIG. 2 and a finished position shown in FIG. 7. Weight arm 40 is connected by a connecting link 44 to the movement arm 16. One end of the connecting link 44 is connected to the leg bar by pivot 45 and bracket 47 and the other end is connected to the weight arm by pivot 46 as best shown in FIG. 2. Weight arm 40 in the preferred embodiment has a generally inverted L shape configuration the lower end of which is pivotally connected to the connecting link 44 as described. One or more resistance weight plates 50 are mounted on the weight arm 40 through means of a horn 52 to provide the desired resistance for the exercise. As best shown in FIG. 8, the frame has a rack including a vertical member 54 and horizontal members 55 with horns 56 fixed thereon for receiving weight plates at different elevations. The uppermost horn is located at the waist-chest area of the exerciser to facilitate movement of the weight plates between the rack and the weight arm, it being understood that the weight arm is located at a level in the weight-chest area as well.

The weight of the weight arm 40 is counterbalanced on opposite sides of its pivot axis 42 by a counterweight 39 fixed to the weight arm 40 as shown in FIG. 2. Similarly the weight of the movement arm 16 is counterbalanced by a counterweight 39 fixed to the movement arm above pivot 18.

Referring to FIG. 1, in order to facilitate entry to and exit from the machine by the exerciser, a prop arm generally designated 60 is pivotally mounted to the frame by pivot 62 for movement between an active position where it projects upwardly for engagement with the weight arm 40 as shown in FIG. 1 and a retracted position for disengagement from the weight arm and storage. When an exercise is concluded, the exerciser pivots prop arm 60 upwardly to support the weight arm in the raised position shown in FIG. 1. A handle 64 is fixed to the prop arm to be conveniently gripped by the exerciser for this purpose.

The resistance provided by the weight plates 50 added to the weight arm 40 is modulated by the linkage which mounts the movement arm 16 to the frame and connects the movement arm to the weight arm 40. This linkage includes movement arm mounting link 20, connecting link 44, the lower leg of weight arm 40 and portions of the frame. The result provides a bell-shaped resistance curve controlled by the location of the pivot points and the lengths of the links. The resistance curve is shaped to match the strength available from the quadriceps muscle group at each angle of movement. At the start of the exercise for example at 135° (degrees) of flexion, the torque level is 0.56 of the peak torque which occurs at 90° (degrees) of flexion. The end of the exercise at full extension or 0° (degrees) flexion has a torque level of 0.25 of the peak value.

Referring to FIG. 1 the limit of travel of the weight arm 40 is controlled in the shown embodiment by a stop (not shown) provided in one of the apertures 70 in a plate 72 fixed to the frame. The stop is engageable with the lower leg of the weight arm at 74 to limit travel of the weight arm and movement arm in the extended positions.

Although a preferred embodiment of the present invention has been shown and described above, it will be appreciated by those of ordinary skill in the art, that various modifications and adaptations of the present invention may be made to the present invention and although not shown and described, will nevertheless lie within the scope of the present invention which is indicated in the appended claims.

What is claimed is:

1. A leg extension exercise machine comprising in combination: a stationary frame, a seat mounted to the frame for receiving an exerciser, a movement arm pivotally mounted to the frame for movement between a retracted position generally located at the front of the seat and an extended position projected forwardly from the seat, a resistance connected to the movement arm to resist movement of the movement arm from the retracted to the extended position, said movement arm including a member to be engaged by the leg for moving the movement arm from retracted to extended position and a foot member for supporting the foot to prevent downward movement of the feet during movement of the movement arm between the retracted and extended positions, and wherein said resistance includes a weight arm pivotally mounted to the frame and a connecting link pivotally connected to the weight arm and pivotally connected to the movement arm whereby said weight arm resists movement of the movement arm from retracted to extended position, and wherein said weight arm has a generally inverted L shape configuration the lower end of which extends below said seat and is connected by said connecting link to the movement arm.

2. The machine defined in claim 1 wherein said movement arm includes a mounting member movable vertically into an adjusted position, and wherein said foot member is connected to said mounting member to move with the mounting member into adjusted position.

3. The machine defined in claim 2 including a handle connected to the mounting member and lock means for securing the mounting member in adjusted position.

4. The machine initially defined in claim 1 wherein said member has elongated concave surface for accommodating the shin of the exerciser.

5. The machine defined in claim 1 including a prop mounted to the frame for movement between an extended position for engaging the weight arm to hold the weight arm in a raised position, and a retracted position spaced from the weight arm for storage.

6. The machine defined in claim 1 wherein said weight arm has means for holding a resistance weight at a level generally in the waist-chest area of the exerciser and wherein the machine further includes a rack on said frame for holding one or more weight plates for storage at the waist-chest area of the exerciser.

7. A leg extension exercise machine comprising in combination, a stationary frame, a seat mounted on the frame for receiving an exerciser, a movement arm pivotally mounted to the frame for movement between a retracted position and an extended position, said movement arm including a leg member engagable by the leg for moving the movement arm from retracted to extended position, a resistance arm pivotally mounted to the frame and connected to said movement arm for providing resistance to movement of the movement arm from the retracted to the extended position, and a prop mounted to the frame for movement between an extended position engaging the weight arm to hold the weight arm in a raised position, and a retracted position away from the weight arm for storage, and wherein said weight arm has a generally inverted L configuration the lower end of which is pivotally connected by a link to said movement arm to transmit movement between the movement arm and said weight arm.

8. The machine defined in claim 7 wherein said prop has a handle to be gripped by an exerciser while seated.

9. The machine defined in claim 7 wherein said prop is pivotally mounted to the frame.

10. A leg extension exercise machine comprising in combination: a stationary frame, a seat mounted to the frame for receiving an exerciser, a movement arm pivotally mounted to the frame for movement between a retracted position generally located at the front of the seat and an extended position projected forwardly from the seat, a resistance connected to the movement arm to resist movement of the movement arm from the retracted to the extended position, said movement arm including a member to be engaged by the leg for moving the movement arm from retracted to extended position, wherein said resistance includes a weight arm pivotally mounted to the frame in a plane above the seat and a connecting link pivotally connected to the weight arm and pivotally connected to the movement arm whereby said weight arm resists movement of the movement arm from retracted to extended position, wherein said weight arm has a lower portion which extends below said seat and is connected by said connecting link to said movement arm, and wherein said movement arm is movable in a range of about one-hundred thirty-five (135) degrees between said retracted and extended positions thereof, and said movement arm, weight arm and connecting link are dimensioned and arranged such that at the start of an exercise when the movement arm is in retracted position the exercise's torque level will be about half of that when the exerciser has moved the movement arm to about ninety (90) degrees from the start of an exercise when the movement arm is in the retracted position.

11. The machine defined in claim 10 including at least one resistance weight removably mounted on said weight arm.

12. The machine defined in claim 10 including at least one resistance weight removably mounted on said weight arm.

* * * * *